US009808941B2

(12) United States Patent
Jacobs et al.

(10) Patent No.: US 9,808,941 B2
(45) Date of Patent: Nov. 7, 2017

(54) SAFETY UTILITY KNIFE ASSEMBLIES, AND COMPONENTS FOR USE WITHIN SAFETY UTILITY KNIFES

(71) Applicant: KLEVER KUTTER LLC, Grand Haven, MI (US)

(72) Inventors: Matthew J. Jacobs, Grand Haven, MI (US); Randolph Scott Presley, Grand Haven, MI (US); Gary Edward Holt, Holland, MI (US)

( * ) Notice: Subject to any disclaimer, the term of this patent is extended or adjusted under 35 U.S.C. 154(b) by 56 days.

(21) Appl. No.: 14/996,342

(22) Filed: Jan. 15, 2016

(65) Prior Publication Data

US 2017/0203448 A1 Jul. 20, 2017

(51) Int. Cl.
*B26B 5/00* (2006.01)
*B26B 9/00* (2006.01)

(52) U.S. Cl.
CPC . *B26B 5/00* (2013.01); *B26B 9/00* (2013.01)

(58) Field of Classification Search
CPC .... B26B 1/02; B26B 1/08; B26B 5/00; B26B 9/00
USPC ..... 30/155, 162
See application file for complete search history.

(56) References Cited

U.S. PATENT DOCUMENTS 4,713,885 A * 12/1987 Keklak ..... B26B 5/003 30/162
5,426,855 A * 6/1995 Keklak ..... B26B 5/003 30/125
6,148,520 A * 11/2000 Berns ..... B26B 5/003 30/162
6,813,833 B2 * 11/2004 Saunders ..... B26B 5/003 30/125
7,322,110 B2 * 1/2008 Hernandez ..... B26B 5/003 30/162
7,603,779 B2 * 10/2009 Rowlay ..... B26B 5/001 30/162
8,056,241 B2 * 11/2011 Davis ..... B26B 5/003 30/162
8,353,109 B2 * 1/2013 Rohrbach ..... B26B 5/003 30/151
8,561,305 B2 * 10/2013 Davis ..... B26B 5/001 30/162
8,707,566 B2 * 4/2014 Rohrbach ..... B26B 5/003 30/151
8,732,957 B2 * 5/2014 Rohrbach ..... B26B 5/003 30/154
8,752,297 B2 * 6/2014 Rohrbach ..... B26B 5/003 30/154
8,776,380 B1 * 7/2014 Quimby ..... B26B 5/003 30/155
8,931,180 B2 * 1/2015 Davis ..... B26B 5/003 30/162
9,370,869 B2 * 6/2016 Hongquan ..... B26B 5/001
2017/0203448 A1 * 7/2017 Jacobs ..... B26B 5/00

* cited by examiner

*Primary Examiner* — Hwei C Payer
(74) *Attorney, Agent, or Firm* — James E. Shultz, Jr.

(57) ABSTRACT

The present disclosure relates to a safety utility knife including a blade carrier that is repositionable between a safety orientation, an intermediate orientation and a cutting orientation via an actuator that is interconnected with the blade carrier via a hingable link. Once the blade carrier is repositioned to the cutting orientation, the blade carrier is automatically returned to the safety orientation anytime a cutting action is discontinued.

10 Claims, 7 Drawing Sheets

SAFETY UTILITY KNIFE ASSEMBLIES, AND COMPONENTS FOR USE WITHIN SAFETY UTILITY KNIFES

RELATED APPLICATIONS

This application is related to U.S. patent application Ser. No. 13/866,074, which was filed on May 3, 2013, the entire disclosure of which is incorporated herein by reference.

FIELD OF THE INVENTION

The present disclosure relates to utility knives. More specifically, the present disclosure relates to safety utility knifes which limit user exposure to associated cutting edges.

BACKGROUND

Utility knives are used for a host of purposes, such as opening cardboard boxes, cutting sheet material, cutting web material, opening packages, etc. Injuries to the users of utility knifes are all too common due to inadvertent contact with the cutting edges of the associated blades. Injuries may be particularly severe when the given utility knife includes a razor blade.

Inadvertent contact with the cutting edges of blades can be equally common during blade removal, insertion and handling. Inadvertent contact with the cutting edges is particularly problematic when a user is removing or inserting a double edge razor blade into an associated utility knife.

Utility knifes that limit user exposure to associated cutting edges are desirable.

SUMMARY

A safety utility knife may include a blade carrier pivotally connected to an actuator via a hinged link, wherein the blade carrier is pivotable between a safety orientation, an intermediate orientation, and a cutting orientation, wherein the actuator is pivotable between a non-actuating orientation and an actuating orientation, and wherein the hinged link includes a blade carrier link portion hingingly connected to an actuator link portion. When the actuator is in the non-actuating orientation and the blade carrier may be in the safety orientation, the blade carrier link portion is not hinged with respect to the actuator link portion. When a user reorients the actuator from the non-actuating orientation to the actuating orientation, the blade carrier may be reoriented from the safety orientation to the intermediate orientation, and the blade carrier link portion is not hinged with respect to the actuator link portion. When the blade carrier is oriented in the intermediate orientation and the user initiates a cutting action, the blade carrier may be reoriented from the intermediate orientation to the cutting orientation and the blade carrier hinges the blade carrier link portion with respect to the actuator link portion. When the blade carrier is oriented in the cutting orientation and the actuator may be oriented in the actuating orientation, and the cutting action is discontinued, the blade carrier link portion is further hinged with respect to the actuator link portion and the blade carrier is reoriented to the safety orientation. When the blade carrier is oriented in the cutting orientation and the actuator is oriented in the non-actuating orientation, and the cutting action is discontinued, the blade carrier link portion may be unhinged with respect to the actuator link portion and the blade carrier is reoriented to the safety orientation.

In another embodiment, a safety utility knife may include a blade carrier repositionable between a safety orientation, an intermediate orientation, and a cutting orientation. The safety utility knife may also include an actuator that may be repositionable between a non-actuating orientation and an actuating orientation. The safety utility knife may further include a hinged link interconnected between the blade carrier and the actuator. The hinged link may include a blade carrier link portion hingingly connected to an actuator link portion.

In a further embodiment, a safety utility knife may include a blade carrier repositionable between a safety orientation, an intermediate orientation, and a cutting orientation. The safety utility knife may also include a blade carrier biasing spring that may bias the blade carrier to the safety orientation. The safety utility knife may further include an actuator that may be repositionable between a non-actuating orientation and an actuating orientation. The safety utility knife may yet further include an actuator biasing spring that may bias the actuator to the non-actuating orientation. The safety utility knife may also include a hinged link, interconnected between the blade carrier and the actuator, that may include a blade carrier link portion hingingly connected to an actuator link portion.

The features and advantages described in this summary and the following detailed description are not all-inclusive. Many additional features and advantages will be apparent to one of ordinary skill in the art in view of the drawings, specification, and claims hereof.

DETAILED DESCRIPTION

The safety utility knife assemblies of the present disclosure incorporate various features that limit user exposure to associated cutting edges. The figures depict exemplary embodiments of safety utility knife assemblies. One skilled in the art will readily recognize from the corresponding written description that alternative embodiments of the structures, that are illustrated herein, may be employed without departing from the principles described.

Figure 1C:
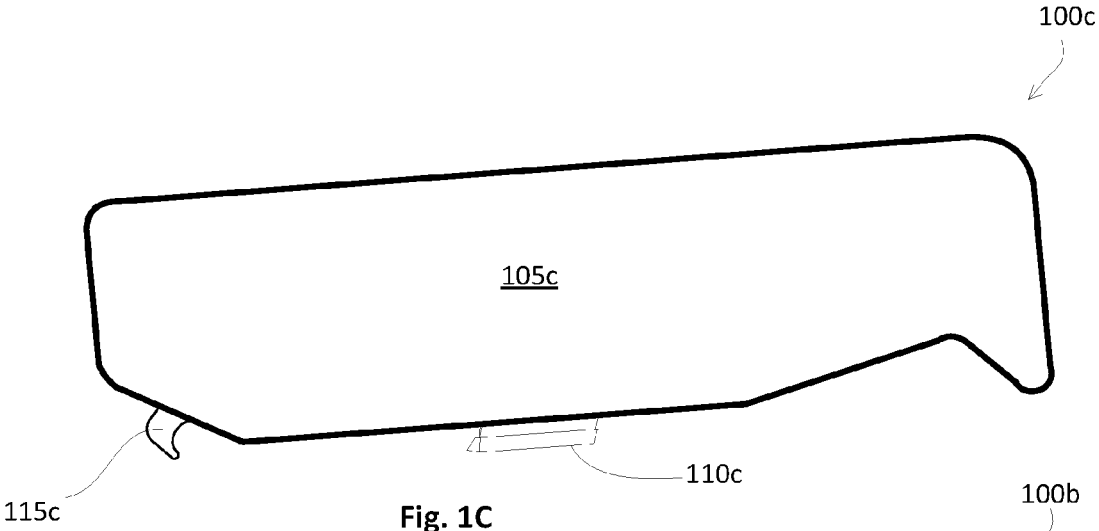
FIGS. 1A-1C depict an example safety utility knife assembly.
Figure 1B:
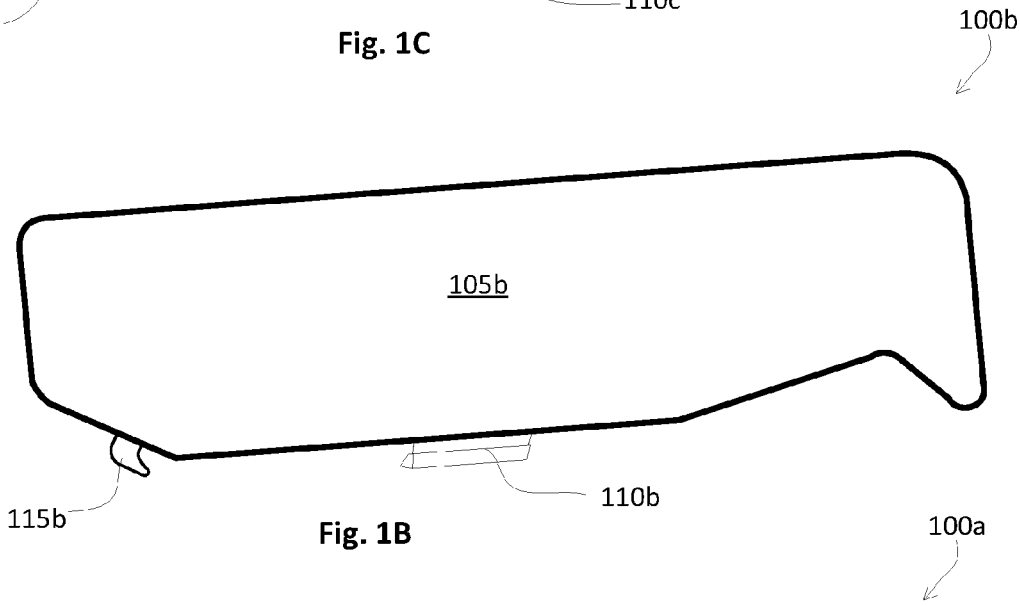
Figure 1A:
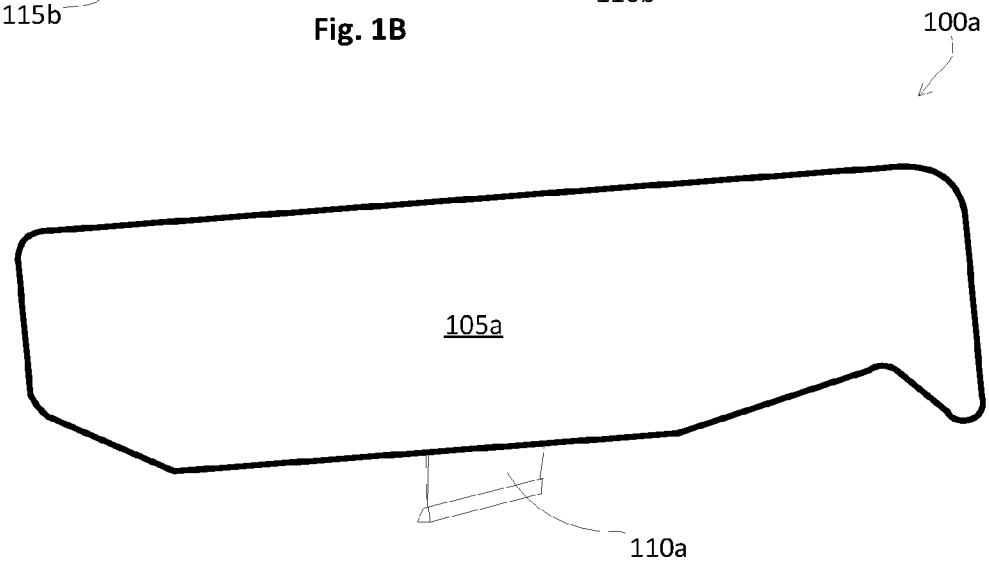

Turning to FIGS. 1A-1C, a safety utility knife 100*a*, 100*b*, 100*c* may include a safety utility knife body 105*a*, 105*b*, 105*c*; an actuator 110*a*, 110*b*, 110*c*; and a blade 115*b*, 115*c*. As described herein, the safety utility knife body 105*a*, 105*b*, 105*c* may function as a user handle, an enclosure, and a mounting structure for various components incorporated within the safety utility knife 100*a*, 100*b*, 100*c*.

As illustrated in FIG. 1A, prior to a user actuating the actuator 110*a*, an associated blade (not shown in FIG. 1A) may be retracted within the safety utility knife body 105*a* (i.e., the blade is oriented in a safety orientation). Accordingly, a user of the safety utility knife 100*a* may not be exposed to any sharp edges (e.g., a cutting edge of a blade) prior to actuating the actuator 110*a*.

As illustrated in FIG. 1B, once a user actuates the actuator 110*b* (e.g., by moving the actuator 110*b* toward the safety utility knife body 105*b*), the blade 115*b* may be oriented into an intermediate orientation. When the blade 115*b* is oriented in the intermediate orientation, a user may have limited exposure to a sharp edge (e.g., a cutting edge of a blade).

As illustrated in FIG. 1C, once the blade 115*b* is oriented in the intermediate position as shown in FIG. 1B, the blade 115*c* may be reoriented into a cutting position in response to, for example, a user bringing the blade 115*b* in contact with an associated material to be cut. As described herein, once the blade 115*c* is oriented in the cutting position as illustrated in FIG. 1C and the blade 115*c* loses contact with whatever caused the blade 115*c* to be oriented in the cutting orientation (e.g., contact with the material to be cut), the blade 115*c* may be automatically reoriented to the safety orientation as illustrated, for example, in FIG. 1A. Notably, as described herein, the blade 115*c* may be automatically reoriented to the safety orientation irrespective of the orientation of the actuator 110*c* (i.e., automatic reorientation of the blade 115*c* to the safety position is describe in detail with respect to FIG. 2D). While the blade 115*b*, 115*c* is depicted in FIGS. 1B and 1C as including an associated cutting edge in a concave configuration, the blade 115*b*, 115*c* may trapezoidal shape as described in commonly assigned U.S. patent application Ser. No. 13/866,074, or the blade 115*b*, 115*c* may include other known shapes.

Figure 2A:
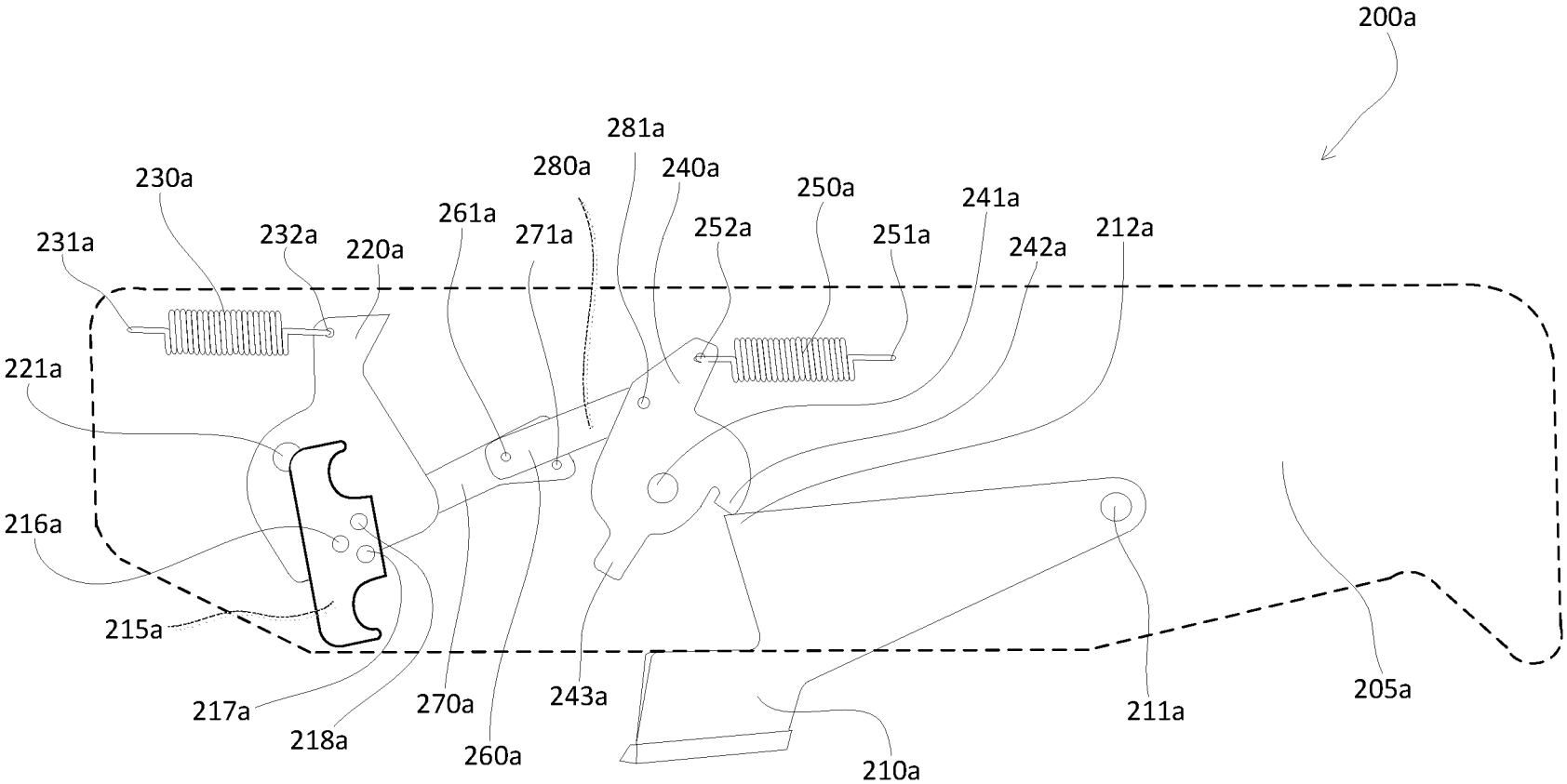
FIGS. 2A-2D depict internal components of the example safety utility knife of FIGS. 1A-1C.

With reference to FIG. 2A, a safety utility knife 200*a* may include a body 205*a* housing a blade carrier 220*a* interconnected with an actuator 240*a* via a hinged link 260*a*. The safety utility knife 200*a* may be similar to, for example, the safety utility knife 110*a* of FIG. 1A. In any event, the actuator 240*a* may be pivotally attached to the body 205*a* via an actuator pivot 241*a*. The hinged link 260*a* may include a blade carrier link portion 270*a* hingably connected to an actuator link portion 280*a* via a hinged link pivot 261*a*. The blade carrier link portion 270*a* may be pivotally attached to the blade carrier 220*a* via a blade carrier link pivot 216*a*. The blade carrier link portion 270*a* may include a hinge stop 271*a* which may be, for example, configured to limit (or prevent) hinging of the hinged link in a predetermined direction. The actuator link portion 280*a* may be pivotally attached to the actuator 240*a* via an actuator link pivot 281*a*.

The safety utility knife 200*a* may include a blade 215*a* replaceably secured to the blade carrier 220*a* via, for example, pins/holes 217*a*, 218*a*. Alternatively, the blade 215*a* and the blade carrier 220*a* may be integrated in a single component. In any event, the blade 215*a* may be constructed as disclosed in commonly assigned U.S. patent application Ser. No. 13/866,074, or the blade 215*a* may be constructed in accordance with other known designs.

The blade carrier 220*a* may be pivotally attached to the body 205*a* via a blade carrier pivot 221*a*. The blade carrier 220*a* may be biased toward the safety orientation as illustrated in FIG. 2A via a blade carrier biasing spring 230*a*. The blade carrier biasing spring 230*a* may be attached to the body 215*a* via a first blade carrier biasing spring attachment 231*a*, and may be attached to the blade carrier 220*a* via a second blade carrier biasing spring attachment 232*a*.

The safety utility knife 200*a* may include a lever 210*a* pivotally attached to the body 215*a* via a lever pivot 211*a*. A lever activating portion 212*a* may cooperate with an actuator portion 242*a* to pivotally reorient the actuator 240*a* about an actuator pivot 241*a* in response to, for example, a user pressing of the lever 210*a*. Alternatively, the lever 210*a* and the actuator 240*a* may be integrated into a single actuator structure. The actuator 220*a* and the lever 210*a* may be biased in a non-actuating orientation, as illustrated in FIG. 2A, via an actuator biasing spring 250*a*. The actuator biasing spring 250*a* may be attached to the actuator 240*a* via a first actuator biasing spring attachment 252*a*, and may be attached to the body 205*a* a second actuator biasing spring attachment 251*a*. The actuator 240*a* may include an actuator stop 243*a* configured to limit rotation of the actuator 240*a*.

Figure 2B:
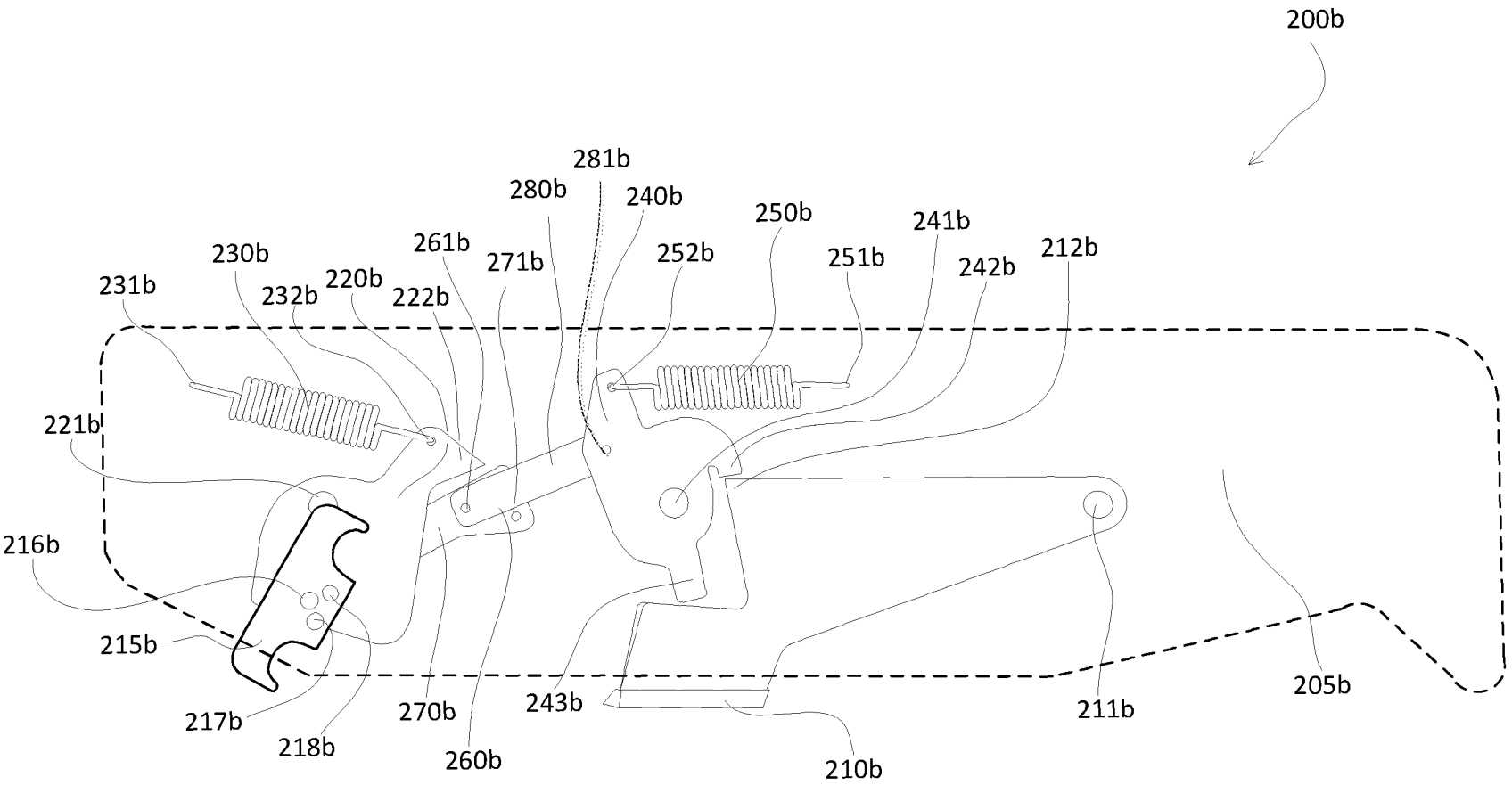

Turning to FIG. 2B, a safety utility knife 200*b* may include a body 205*b* housing a blade carrier 220*b* interconnected with an actuator 240*b* via a hinged link 260*b*. The safety utility knife 200*b* may be similar to, for example, the safety utility knife 100*b* of FIG. 1B. In any event, the actuator 240*b* may be pivotally attached to the body 205*b* via an actuator pivot 241*b*. The hinged link 260*b* may include a blade carrier link portion 270*b* hingably connected to an actuator link portion 280*b* via a hinged link pivot 261*b*. The blade carrier link portion 270*b* may be pivotally attached to the blade carrier 220*b* via a blade carrier link pivot 216*b*. The blade carrier link portion 270*b* may include a hinge stop 271*b* which may be, for example, configured to limit (or prevent) hinging of the hinged link in a predetermined direction. The actuator link portion 280*b* may be pivotally attached to the actuator 240*b* via an actuator link pivot 281*b*.

The safety utility knife 200*b* may include a blade 215*b* replaceably secured to the blade carrier 220*b* via, for example, pins/holes 217*b*, 218*b*. Alternatively, the blade 215*b* and the blade carrier 220*b* may be integrated in a single component. In any event, the blade 215*b* may be constructed as disclosed in commonly assigned U.S. patent application Ser. No. 13/866,074, or the blade 215*b* may be constructed in accordance with other known designs.

The blade carrier 220*b* may be pivotally attached to the body 205*b* via a blade carrier pivot 221*b*. The blade carrier 220*b* may include a blade carrier hinge initiating portion 222*b*. The blade carrier 220*b* may be biased toward the safety orientation as illustrated in FIG. 2A via a blade carrier biasing spring 230*b*. The blade carrier biasing spring 230*b* may be attached to the body 215*b* via a first blade carrier biasing spring attachment 231*b*, and may be attached to the blade carrier 220*b* via a second blade carrier biasing spring attachment 232*b*.

The safety utility knife 200*b* may include a lever 210*b* pivotally attached to the body 215*b* via a lever pivot 211*b*. A lever activating portion 212*b* may cooperate with an actuator portion 242*b* to pivotally reorient the actuator 240 of FIG. 2A about an actuator pivot 241*b*, in response to, for example, a user pressing of the lever 210*b*, to an intermediate position as illustrated in FIG. 2B. More particularly, when a user presses the lever 210*b*, the lever 210*b* may rotate the actuator 240*b* which, in turn, may rotate the blade carrier 220*a* to the intermediate orientation via the hinged link 260*b*. Notably, the blade carrier link portion 270*b*, of the hinged link 260*b*, is not hinged with respect to the actuator link portion, of the hinged link 260*b*, while the blade 215*a* is reoriented from the safety orientation of FIG. 2A to the intermediate orientation of FIG. 2B.

The lever 210*b* and the actuator 240*b* may be integrated into a single actuator structure. The actuator 240*b* and the lever 210*b* may be biased in a non-actuating orientation, as illustrated in FIG. 2A, via an actuator biasing spring 250*b*. The actuator biasing spring 250*b* may be attached to the actuator 240*b* via a first actuator biasing spring attachment 252*b*, and may be attached to the body 205*b* a second actuator biasing spring attachment 251*b*. The actuator 240*b* may include an actuator stop 243*b* configured to limit rotation of the actuator 240*b*.

Figure 2C:
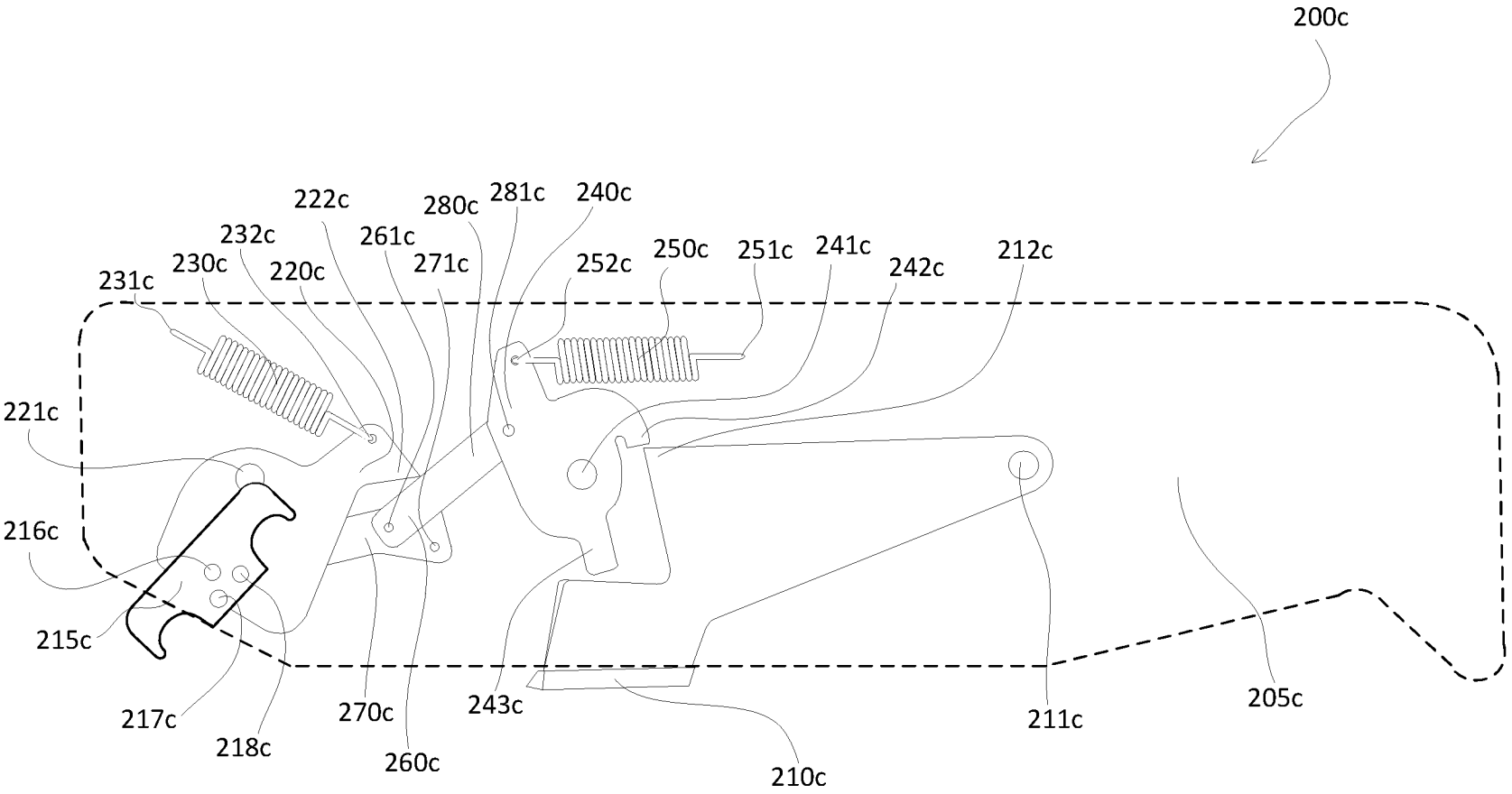

With reference to FIG. 2C, a safety utility knife 200*c* may include a body 205*c* housing a blade carrier 220*c* interconnected with an actuator 240*c* via a hinged link 260*c*. The safety utility knife 200*c* may be similar to, for example, the safety utility knife 100*c* of FIG. 1C. In any event, the actuator 240*c* may be pivotally attached to the body 205*c* via an actuator pivot 241*c*. The hinged link 260*c* may include a blade carrier link portion 270*c* hingably connected to an actuator link portion 280*c* via a hinged link pivot 261*c*. The blade carrier link portion 270*c* may be pivotally attached to the blade carrier 220*c* via a blade carrier link pivot 216*c*. The blade carrier link portion 270*c* may include a hinge stop 271*c* which may be, for example, configured to limit (or prevent) hinging of the hinged link in a predetermined direction. The actuator link portion 280*c* may be pivotally attached to the actuator 240*c* via an actuator link pivot 281*c*.

The safety utility knife 200*c* may include a blade 215*c* replaceably secured to the blade carrier 220*c* via, for example, pins/holes 217*c*, 218*c*. Alternatively, the blade 215*c* and the blade carrier 220*c* may be integrated in a single component. In any event, the blade 215*c* may be constructed as disclosed in commonly assigned U.S. patent application Ser. No. 13/866,074, or the blade 215*c* may be constructed in accordance with other known designs.

The blade carrier 220*c* may be pivotally attached to the body 205*c* via a blade carrier pivot 221*c*. The blade carrier 220*c* may be biased toward the safety orientation as illustrated in FIG. 2A via a blade carrier biasing spring 230*c*. The blade carrier biasing spring 230*c* may be attached to the body 205*c* via a first blade carrier biasing spring attachment 231*c*, and may be attached to the blade carrier 220*c* via a second blade carrier biasing spring attachment 232*c*.

The safety utility knife 200*c* may include a lever 210*c* pivotally attached to the body 205*c* via a lever pivot 211*c*. The lever 210*c* may include a lever activating portion 212*c* that may cooperate with an actuator portion 242*c* to pivotally reorient the actuator 240*c* about an actuator pivot 241*c*.

The blade 215*b* may be reoriented to a cutting orientation, as illustrated in FIG. 2C, in response to, for example, a user bringing the blade 215*b* in contact with something (e.g., bringing the blade 215*b* in contact with a material to be cut). More particularly, when a user presses the lever 210*a*, the lever 210*a* may rotate the actuator 240*a* which, in turn, may rotate the blade carrier 220*a* to the intermediate orientation, as illustrated in FIG. 2A, via the hinged link 260*b*. Notably, the blade carrier link portion 270*b*, of the hinged link 260*b*, is not hinged with respect to the actuator link portion, of the hinged link 260*b*, while the blade 215*a* is reoriented from the safety orientation of FIG. 2A to the intermediate orientation of FIG. 2B. Once the blade 215*b* is oriented to the intermediate orientation, as illustrated, in FIG. 2B, the blade 215*b* may be reoriented to a cutting orientation, as illustrated in FIG. 2C, in response to, for example, a user bringing the blade 215*b* in contact with something (e.g., bringing the blade 215*b* in contact with a material to be cut). As further illustrated in FIG. 2C, when the blade 215*c* is oriented to the cutting orientation, as illustrated in FIG. 2C, a blade carrier hinge initiating portion 222*c* may cause the blade carrier link portion 270*c* to hinge with respect to the actuator link portion 280*c*, thereby, allowing the blade 215*c* to freely return to the safety orientation, as illustrated in FIG. 2A, when the blade 215*c* is no longer in contact with whatever caused the blade 215*c* to be oriented to the cutting orientation. Notably, the blade 215*c* is free to automatically return to the safety orientation irrespective of whether the lever 210*c* is pressed or not.

The lever 210*c* and the actuator 240*c* may be integrated into a single actuator structure. The actuator 240*c* and the lever 210*c* may be biased in a non-actuating orientation, as illustrated in FIG. 2A, via an actuator biasing spring 250*c*. The actuator biasing spring 250*c* may be attached to the actuator 240*c* via a first actuator biasing spring attachment 252*c*, and may be attached to the body 205*c* a second actuator biasing spring attachment 252*c*. The actuator 240*c* may include an actuator stop 243*c* configured to limit rotation of the actuator 240*c*.

Figure 2D:
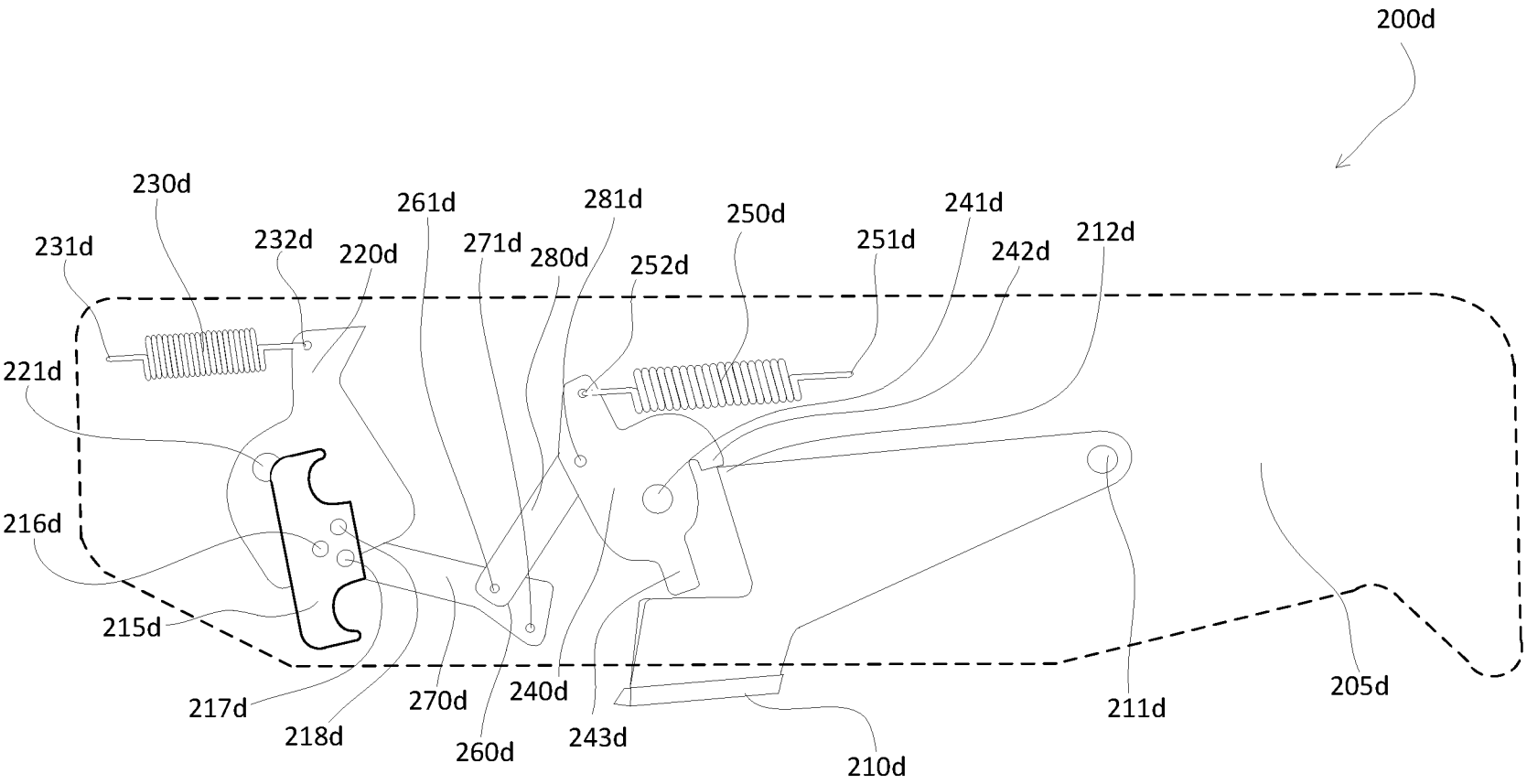

Turning to FIG. 2D, a safety utility knife 200*d* may include a body 205*d* housing a blade carrier 220*d* interconnected with an actuator 240*d* via a hinged linked 260*d*. The safety utility knife 200*d* may be similar to, for example, the safety utility knife 100*a* of FIG. 1A. In any event, the actuator 240*d* may be pivotally attached to the body 205*d* via an actuator pivot 241*d*. The hinged link 260*d* may include a blade carrier link portion 270*d* hingably connected to an actuator link portion 280*d* via a hinged link pivot 261*d*. The blade carrier link portion 270*d* may be pivotally attached to the blade carrier 220*d* via a blade carrier link pivot 216*d*. The blade carrier link portion 270*d* may include a hinge stop 271*d* which may be, for example, configured to limit (or prevent) hinging of the hinged link in a predetermined direction. The actuator link portion 280*d* may be pivotally attached to the actuator 240*d* via an actuator link pivot 281*d*.

The safety utility knife 200*d* may include a blade 215*d* replaceably secured to the blade carrier 220*d* via, for example, pins/holes 217*d*, 218*d*. Alternatively, the blade 215*d* and the blade carrier 220*d* may be integrated in a single component. In any event, the blade 215*d* may be constructed as disclosed in commonly assigned U.S. patent application Ser. No. 13/866,074, or the blade 215*d* may be constructed in accordance with other known designs.

The blade carrier 220*d* may be pivotally attached to the body 205*d* via a blade carrier pivot 221*d*. The blade carrier 220*d* may be biased toward the safety orientation as illustrated in FIG. 2A via a blade carrier biasing spring 230*d*. The blade carrier biasing spring 230*d* may be attached to the body 205*d* via a first blade carrier biasing spring attachment 231*d*, and may be attached to the blade carrier 220*d* via a second blade carrier biasing spring attachment 232*d*.

The safety utility knife 200*d* may include a lever 210*d* pivotally attached to the body 205*d* via a lever pivot 211*d*. The lever 210*d* may include an lever activating portion 212*d* that may cooperate with an actuator portion 242*d* to pivotally reorient the actuator 240*d* about an actuator pivot 241*c*.

The blade 215*c* may be automatically reoriented from a cutting orientation, as illustrated in FIG. 2C, when the blade 215*c* is no longer in contact with whatever caused the blade 215*c* to be oriented to the cutting orientation. Notably, the blade 215*c* is free to automatically return to the, safety orientation as illustrated in FIG. 2D, irrespective of whether the lever 210*d* is pressed or not.

The lever 210*d* and the actuator 240*d* may be integrated into a single actuator structure. The actuator 240*d* and the lever 210*d* may be biased in a non-actuating orientation, as illustrated in FIG. 2A, via an actuator biasing spring 250*d*. The actuator biasing spring 250*d* may be attached to the actuator 240*d* via a first actuator biasing spring attachment 252*d*, and may be attached to the body 205*d* via a second actuator biasing spring attachment 251*d*. The actuator 240*d* may include an actuator stop 243*d* configured to limit rotation of the actuator 240*d*.

With further referenced to FIGS. 2D and 2A, when a user releases the lever 210*d*, the hinged link 260*d* of FIG. 2D may be reoriented as illustrated by hinged link 260*a* of FIG. 2A. Once the hinged link 260*d* is reoriented as illustrated by hinged link 260*a*, the user may cycle the safety utility knife 200*a*, 200*b*, 200*c*, 200*d* as described with regard to FIGS. 2A-2D.

For example, the safety utility knife 200*a*, 200*b*, 200*c*, 200*d* may include a blade carrier pivotally connected to an actuator via a hinged link, wherein the blade carrier is pivotable between a safety orientation, an intermediate orientation, and a cutting orientation, wherein the actuator is pivotable between a non-actuating orientation and an actuating orientation, and wherein the hinged link includes a blade carrier link portion hingingly connected to an actuator link portion. When the actuator is in the non-actuating orientation and the blade carrier may be in the safety orientation, the blade carrier link portion is not hinged with respect to the actuator link portion. When a user reorients the actuator from the non-actuating orientation to the actuating orientation, the blade carrier may be reoriented from the safety orientation to the intermediate orientation, and the blade carrier link portion is not hinged with respect to the actuator link portion. When the blade carrier is oriented in the intermediate orientation and the user initiates a cutting action, the blade carrier may be reoriented from the intermediate orientation to the cutting orientation and the blade carrier hinges the blade carrier link portion with respect to the actuator link portion. When the blade carrier is oriented in the cutting orientation and the actuator may be oriented in the actuating orientation, and the cutting action is discontinued, the blade carrier link portion is further hinged with respect to the actuator link portion and the blade carrier is reoriented to the safety orientation. When the blade carrier is oriented in the cutting orientation and the actuator is oriented in the non-actuating orientation, and the cutting action is discontinued, the blade carrier link portion may be unhinged with respect to the actuator link portion and the blade carrier is reoriented to the safety orientation.

The safety utility knife may include a blade carrier biasing spring that may bias the blade carrier to the safety orientation. The safety utility knife may include an actuator biasing spring that may bias the actuator to the non-actuating orientation.

As another example, the safety utility knife 200*a*, 200*b*, 200*c*, 200*d* may include a blade carrier repositionable between a safety orientation, an intermediate orientation, and a cutting orientation. The safety utility knife may also include an actuator that may be repositionable between a non-actuating orientation and an actuating orientation. The safety utility knife may further include a hinged link interconnected between the blade carrier and the actuator. The hinged link may include a blade carrier link portion hingingly connected to an actuator link portion. When the actuator is in the non-actuating orientation and the blade carrier is in the safety orientation, the blade carrier link portion may not be hinged with respect to the actuator link portion.

The safety utility knife may include a blade carrier biasing spring that may bias the blade carrier to the safety orientation. The safety utility knife may include an actuator biasing spring that may bias the actuator to the non-actuating orientation.

When a user reorients the actuator from the non-actuating orientation to the actuating orientation, the blade carrier may be reoriented from the safety orientation to the intermediate orientation, and the blade carrier link portion may not be hinged with respect to the actuator link portion. When the blade carrier is oriented in the intermediate orientation and the user initiates a cutting action, the blade carrier may be reoriented from the intermediate orientation to the cutting orientation and the blade carrier may hinge the blade carrier link portion with respect to the actuator link portion. When the blade carrier is oriented in the cutting orientation and the actuator is oriented in the actuating orientation, and the cutting action is discontinued, the blade carrier link portion may be further hinged with respect to the actuator link portion and the blade carrier may be reoriented to the safety orientation. When the blade carrier is oriented in the cutting orientation and the actuator is oriented in the non-actuating orientation, and the cutting action is discontinued, the blade carrier link portion may be unhinged with respect to the actuator link portion and the blade carrier may be reoriented to the safety orientation.

As yet another example, a safety utility knife 200*a*, 200*b*, 200*c*, 200*d* may include a blade carrier repositionable between a safety orientation, an intermediate orientation, and a cutting orientation. The safety utility knife may also include a blade carrier biasing spring that may bias the blade carrier to the safety orientation. The safety utility knife may further include an actuator that may be repositionable between a non-actuating orientation and an actuating orientation. The safety utility knife may yet further include an actuator biasing spring that may bias the actuator to the non-actuating orientation. The safety utility knife may also include a hinged link, interconnected between the blade carrier and the actuator, that may include a blade carrier link portion hingingly connected to an actuator link portion. The safety utility knife may include an enclosure, and at least one of: the blade carrier or the actuator, may be pivotally secured to the enclosure. The safety utility knife may further include an internal frame, and at least one of: the blade carrier or the actuator, may be pivotally secured to the internal frame. The safety utility knife may further include a blade replaceably secured to the blade carrier.

The safety utility knife may include a blade carrier biasing spring that may bias the blade carrier to the safety orientation. The safety utility knife may include an actuator biasing spring that may bias the actuator to the non-actuating orientation.

When a user reorients the actuator from the non-actuating orientation to the actuating orientation, the blade carrier may be reoriented from the safety orientation to the intermediate orientation, and the blade carrier link portion may not be hinged with respect to the actuator link portion. When the blade carrier is oriented in the intermediate orientation and the user initiates a cutting action, the blade carrier may be reoriented from the intermediate orientation to the cutting orientation and the blade carrier may hinge the blade carrier link portion with respect to the actuator link portion. When the blade carrier is oriented in the cutting orientation and the actuator is oriented in the actuating orientation, and the cutting action is discontinued, the blade carrier link portion may be further hinged with respect to the actuator link portion and the blade carrier may be reoriented to the safety orientation. When the blade carrier is oriented in the cutting orientation and the actuator is oriented in the non-actuating orientation, and the cutting action is discontinued, the blade carrier link portion may be unhinged with respect to the actuator link portion and the blade carrier may be reoriented to the safety orientation.

Figure 3:
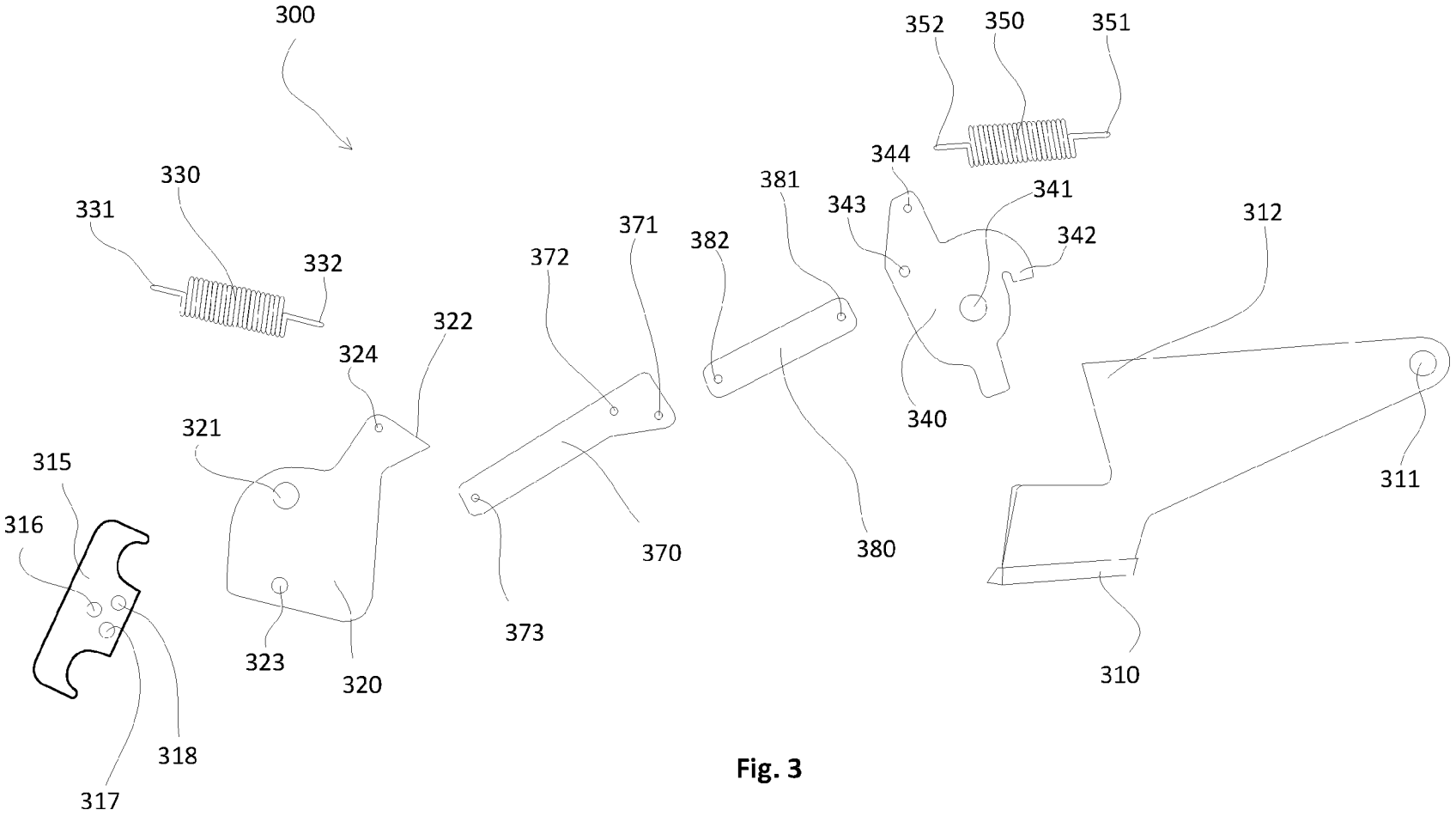
FIG. 3 depicts an exploded view of the components of the example safety utility knife of FIGS. 1A-1C.

Turning to FIG. 3, an exploded view of various components of a safety utility knife 300 is depicted. The safety utility knife 300 may include a lever 310, a blade 315, a blade carrier 320, a blade carrier biasing spring 330, an actuator 340, an actuator biasing spring 350, a blade carrier link portion 370, and an actuator link portion 380. While any one of, or all of, the lever 310, the blade 315, the blade carrier 320, the blade carrier biasing spring 330, the actuator 340, the actuator biasing spring 350, the blade carrier link portion 370, and the actuator link portion 380 may be secured to a body (e.g., body 115*a* of FIG. 1A), any one of, or all of, the lever 310, the blade 315, the blade carrier 320, the blade carrier biasing spring 330, the actuator 340, the actuator biasing spring 350, the blade carrier link portion 370, and the actuator link portion 380 may be secured to a frame structure (not shown in FIG. 3) which, in turn, may be secured within a body (e.g., body 115*a* of FIG. 1A).

The lever 310 may include a lever pivot 311 and an actuator interface portion 312. The blade 315 may include blade attachments 316, 317, 318 to, for example, replaceably secure the blade 315 to the blade carrier 320. The blade carrier 320 may include a blade carrier pivot 321, a blade carrier biasing spring attachment 324, a blade/blade carrier link attachment 323, and a hinge link hinge initiation portion 322. The blade carrier biasing spring 330 may include a first blade carrier biasing spring attachment 331 and a second blade carrier biasing spring attachment 332. The actuator 340 may include an actuator pivot 341, a lever interaction portion 342, and an actuator hinge link portion attachment 343. The actuator biasing spring 350 may include a first actuator biasing spring attachment 351 and a second actuator biasing spring attachment 352. The blade carrier link portion 370 may include a hinge stop 371, an attachment link portion attachment 372, and a blade carrier attachment 373. The actuator link portion 380 may include an actuator attachment 381 and a blade carrier link portion attachment 382.

Figures 4A, 4B, 4C:
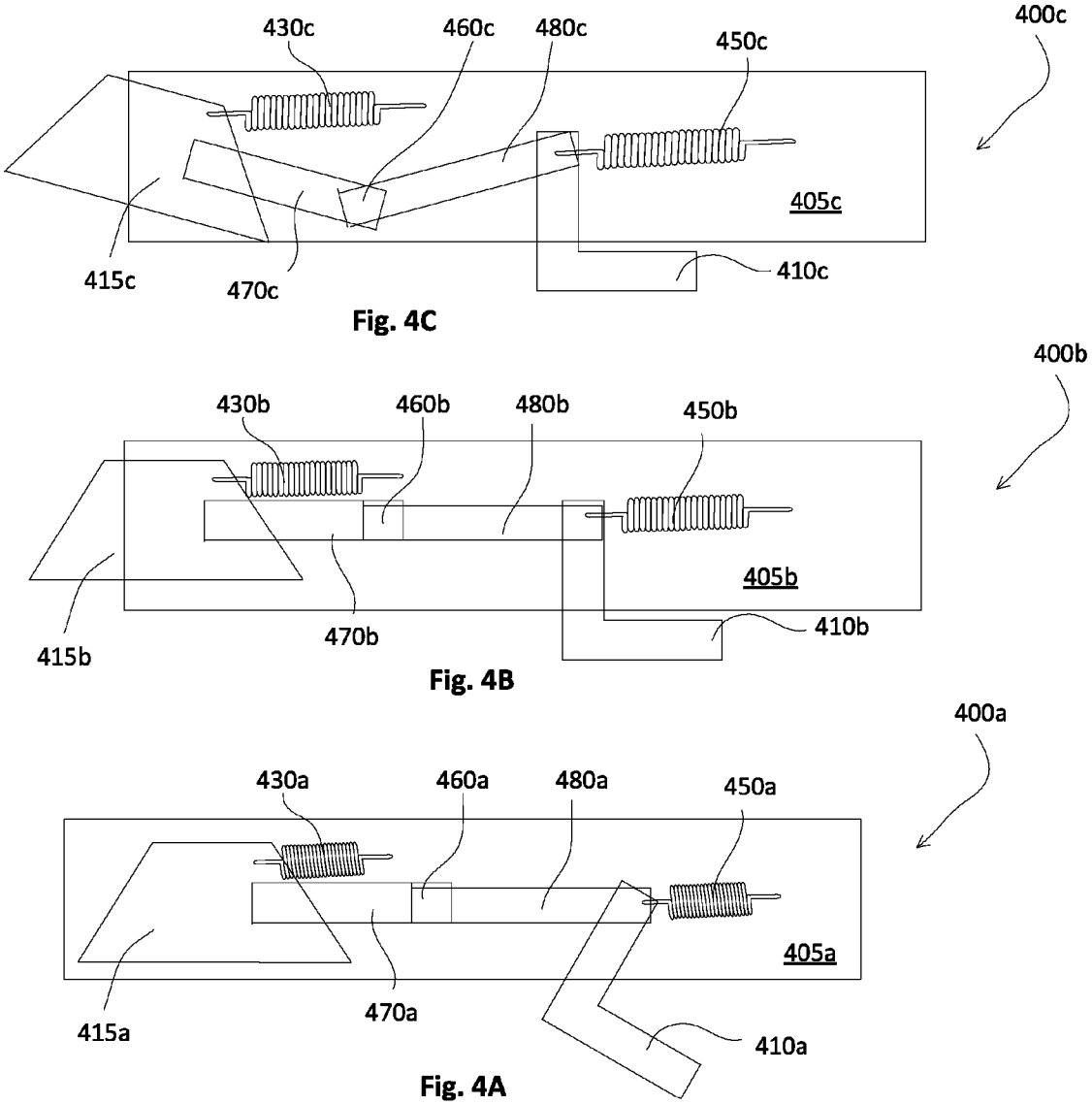
FIGS. 4A-4C depict another example safety utility knife assembly.

With reference to FIGS. 4A-4C, a safety utility knife 400*a*, 400*b*, 400*c* may include a body 405*a*, 405*b*, 405*c*; an actuator/lever 410*a*, 410*b*, 410*c*; a blade 415*a*, 415*b*, 415*c*; a blade biasing spring 430*a*, 430*b*, 430*c*; an actuator/lever biasing spring 450*a*, 450*b*, 450*c*; and a hinged link 460*a*, 460*b*, 460*c*. The hinged link 460*a*, 460*b*, 460*c* may include a blade link portion 470*a*, 470*b*, 470*c* and an actuator/lever link portion 480*a*, 480*b*, 480*c*. The safety utility knife 400*a* may be similar to the safety utility knife 100*a* of FIG. 1A and the safety utility knife 200*a* of FIG. 2A in function, however, the blade 415*a* reorients in a linear fashion as opposed to the rotary fashion of blade 115*a*, 215*a*. The safety utility knife 400*b* may be similar to the safety utility knife 100*b* of FIG. 1B and the safety utility knife 200*b* of FIG. 2B in function, however, the blade 415*b* reorients in a linear fashion as opposed to the rotary fashion of blade 115*b*, 215*b*. The safety utility knife 400*c* may be similar to the safety utility knife 100*c* of FIG. 1C and the safety utility knife 200*c* of FIG. 2C in function, however, the blade 415*c* reorients in a linear fashion as opposed to the rotary fashion of blade 115*c*, 215*c*.

For example, the safety utility knife 400*a*, 400*b*, 400*c* may include a blade carrier pivotally connected to an actuator via a hinged link, wherein the blade carrier is pivotable between a safety orientation, an intermediate orientation, and a cutting orientation, wherein the actuator/lever is pivotable between a non-actuating orientation and an actuating orientation, and wherein the hinged link includes a blade carrier link portion hingingly connected to an actuator link portion. When the actuator/lever is in the non-actuating orientation and the blade carrier may be in the safety orientation, the blade carrier link portion is not hinged with respect to the actuator link portion. When a user reorients the actuator/lever from the non-actuating orientation to the actuating orientation, the blade carrier may be reoriented from the safety orientation to the intermediate orientation, and the blade carrier link portion is not hinged with respect to the actuator link portion. When the blade carrier is oriented in the intermediate orientation and the user initiates a cutting action, the blade carrier may be reoriented from the intermediate orientation to the cutting orientation and the blade carrier hinges the blade carrier link portion with respect to the actuator link portion. When the blade carrier is oriented in the cutting orientation and the actuator may be oriented in the actuating orientation, and the cutting action is discontinued, the blade carrier link portion is further hinged with respect to the actuator link portion and the blade carrier is reoriented to the safety orientation. When the blade carrier is oriented in the cutting orientation and the actuator/lever is oriented in the non-actuating orientation, and the cutting action is discontinued, the blade carrier link portion may be unhinged with respect to the actuator link portion and the blade carrier is reoriented to the safety orientation.

The safety utility knife may include a blade carrier biasing spring that may bias the blade carrier to the safety orientation. The safety utility knife may include an actuator biasing spring that may bias the actuator/lever to the non-actuating orientation.

As another example, the safety utility knife 400*a*, 400*b*, 400*c* may include a blade carrier repositionable between a safety orientation, an intermediate orientation, and a cutting orientation. The safety utility knife may also include an actuator/lever that may be repositionable between a non-actuating orientation and an actuating orientation. The safety utility knife may further include a hinged link interconnected between the blade carrier and the actuator/lever. The hinged link may include a blade carrier link portion hingingly connected to an actuator link portion. When the actuator/lever is in the non-actuating orientation and the blade carrier is in the safety orientation, the blade carrier link portion may not be hinged with respect to the actuator link portion.

The safety utility knife may include a blade carrier biasing spring that may bias the blade carrier to the safety orientation. The safety utility knife may include an actuator biasing spring that may bias the actuator/lever to the non-actuating orientation.

When a user reorients the actuator/lever from the non-actuating orientation to the actuating orientation, the blade carrier may be reoriented from the safety orientation to the intermediate orientation, and the blade carrier link portion may not be hinged with respect to the actuator link portion. When the blade carrier is oriented in the intermediate orientation and the user initiates a cutting action, the blade carrier may be reoriented from the intermediate orientation to the cutting orientation and the blade carrier may hinge the blade carrier link portion with respect to the actuator link portion. When the blade carrier is oriented in the cutting orientation and the actuator/lever is oriented in the actuating orientation, and the cutting action is discontinued, the blade carrier link portion may be further hinged with respect to the actuator link portion and the blade carrier may be reoriented to the safety orientation. When the blade carrier is oriented in the cutting orientation and the actuator/lever is oriented in the non-actuating orientation, and the cutting action is discontinued, the blade carrier link portion may be unhinged with respect to the actuator link portion and the blade carrier may be reoriented to the safety orientation.

As yet another example, a safety utility knife 400*a*, 400*b*, 400*c* may include a blade carrier repositionable between a safety orientation, an intermediate orientation, and a cutting orientation. The safety utility knife may also include a blade carrier biasing spring that may bias the blade carrier to the safety orientation. The safety utility knife may further include an actuator/lever that may be repositionable between a non-actuating orientation and an actuating orientation. The safety utility knife may yet further include an actuator biasing spring that may bias the actuator/lever to the non-actuating orientation. The safety utility knife may also include a hinged link, interconnected between the blade carrier and the actuator, that may include a blade carrier link portion hingingly connected to an actuator link portion. The safety utility knife may include an enclosure, and at least one of: the blade carrier or the actuator/lever, may be pivotally secured to the enclosure. The safety utility knife may further include an internal frame, and at least one of: the blade carrier or the actuator/lever, may be pivotally secured to the internal frame. The safety utility knife may further include a blade replaceably secured to the blade carrier.

The safety utility knife may include a blade carrier biasing spring that may bias the blade carrier to the safety orientation. The safety utility knife may include an actuator biasing spring that may bias the actuator/lever to the non-actuating orientation.

When a user reorients the actuator/lever from the non-actuating orientation to the actuating orientation, the blade carrier may be reoriented from the safety orientation to the intermediate orientation, and the blade carrier link portion may not be hinged with respect to the actuator link portion. When the blade carrier is oriented in the intermediate orientation and the user initiates a cutting action, the blade carrier may be reoriented from the intermediate orientation to the cutting orientation and the blade carrier may hinge the blade carrier link portion with respect to the actuator link portion. When the blade carrier is oriented in the cutting orientation and the actuator/lever is oriented in the actuating orientation, and the cutting action is discontinued, the blade carrier link portion may be further hinged with respect to the actuator link portion and the blade carrier may be reoriented to the safety orientation. When the blade carrier is oriented in the cutting orientation and the actuator/lever is oriented in the non-actuating orientation, and the cutting action is discontinued, the blade carrier link portion may be unhinged with respect to the actuator link portion and the blade carrier may be reoriented to the safety orientation.

Upon reading this disclosure, those of skill in the art will appreciate still additional alternative structural and functional designs for safety blades for use in utility knife assemblies, utility knife assemblies and methods of manufacturing. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the apparatuses and methods disclosed herein without departing from the spirit and scope defined in the appended claims.

What is claimed is:

1. A safety utility knife, comprising:

a blade carrier pivotally connected to an actuator via a hinged link, wherein the blade carrier is pivotable from a safety orientation to an intermediate orientation, and from the intermediate orientation to a cutting orientation, wherein the actuator is pivotable between a non-actuating orientation and an actuating orientation, wherein the hinged link includes a blade carrier link portion hingingly connected to an actuator link portion, and wherein the blade carrier link portion is rotatably connected to the blade carrier;

a blade replaceably secured within the blade carrier; and a blade carrier hinge initiating portion fixed to the blade carrier, wherein, when the blade carrier is in the safety orientation, the blade carrier hinge initiation portion is not engaged with the actuator link portion and the blade carrier link portion, and wherein, when the blade carrier is in the cutting orientation, the blade carrier hinge initiating portion engages the actuator link portion to hinge the blade carrier link portion with respect to the actuator link portion.

2. The safety utility knife as in claim 1, further comprising:

a blade carrier biasing spring, wherein the blade carrier biasing spring biases the blade carrier to the safety orientation.

3. The safety utility knife as in claim 1, further comprising:

an actuator biasing spring, wherein the actuator biasing spring biases the actuator to the non-actuating orientation.

4. A safety utility knife, comprising:

a blade carrier repositionable from a safety orientation to an intermediate orientation, and from the intermediate orientation to a cutting orientation;

a blade replaceably secured within the blade carrier;

a blade carrier hinge initiating portion fixed to the blade carrier;

an actuator, wherein the actuator is repositionable between a non-actuating orientation and an actuating orientation; and a hinged link interconnected between the blade carrier and the actuator, wherein the hinged link includes a blade carrier link portion hingingly connected to an actuator link portion, wherein the blade carrier link portion is rotatably connected to the blade carrier wherein, when the blade carrier is in the safety orientation, the blade carrier hinge initiation portion is not engaged with the actuator link portion and the blade carrier link portion, and wherein, when the blade carrier is in the cutting orientation, the blade carrier hinge initiating portion engages the actuator link portion to hinge the blade carrier link portion with respect to the actuator link portion.

5. The safety utility knife as in claim 4, further comprising:

a blade carrier biasing spring, wherein the blade carrier biasing spring biases the blade carrier to the safety orientation.

6. The safety utility knife as in claim 4, further comprising:

an actuator biasing spring, wherein the actuator biasing spring biases the actuator to the non-actuating orientation.

7. A safety utility knife, comprising:

a blade carrier repositionable from a safety orientation to an intermediate orientation, and from the intermediate orientation to a cutting orientation;

a blade positioned within the blade carrier;

a blade carrier hinge initiating portion fixed to the blade carrier;

a blade carrier biasing spring, wherein the blade carrier biasing spring biases the blade carrier to the safety orientation;

an actuator, wherein the actuator is repositionable between a non-actuating orientation and an actuating orientation;

an actuator biasing spring, wherein the actuator biasing spring biases the actuator to the non-actuating orientation; and a hinged link interconnected between the blade carrier and the actuator, wherein the hinged link includes a blade carrier link portion hingingly connected to an actuator link portion, and wherein the blade carrier link portion is rotatably connected to the blade carrier wherein, when the blade carrier is in the safety orientation, the blade carrier hinge initiation portion is not engaged with the actuator link portion and the blade carrier link portion, and wherein, when the blade carrier is in the cutting orientation, the blade carrier hinge initiating portion engages the actuator link portion to hinge the blade carrier link portion with respect to the actuator link portion.

8. The safety utility knife as in claim 7, further comprising:

an enclosure, wherein at least one of: the blade carrier or the actuator, is pivotally secured to the enclosure.

9. The safety utility knife as in claim 7, further comprising:

a body, wherein at least one of: the blade carrier or the actuator, is pivotally secured to the body.

10. The safety utility knife as in claim 7, wherein the blade is replaceably secured to the blade carrier.

* * * * *